US010258863B2

(12) United States Patent
Swaynie et al.

(10) Patent No.: US 10,258,863 B2
(45) Date of Patent: Apr. 16, 2019

(54) CONVERTIBLE BINDING

(71) Applicant: Swaynie Enterprises LLC, Denver, CO (US)

(72) Inventors: Alexander Swaynie, Denver, CO (US); Marc Andrew Hanchak, Denver, CO (US); Peter Schuyler Livingston, Denver, CO (US); Shane Jerid Korthuis, Denver, CO (US); Matthew Michael Vellone, Boulder, CO (US); Michael Ross Swaynie, Castle Rock, CO (US)

(73) Assignee: Swaynie Enterprises, LLC, Denver, CO (US)

( * ) Notice: Subject to any disclaimer, the term of this patent is extended or adjusted under 35 U.S.C. 154(b) by 0 days.

(21) Appl. No.: 15/960,898

(22) Filed: Apr. 24, 2018

(65) Prior Publication Data

US 2018/0304142 A1 Oct. 25, 2018

Related U.S. Application Data

(60) Provisional application No. 62/489,203, filed on Apr. 24, 2017.

(51) Int. Cl.

| | |
|---|---|
| ***A63C 13/00*** | (2006.01) |
| ***A63C 10/24*** | (2012.01) |
| ***A63C 10/02*** | (2012.01) |

(52) U.S. Cl.

CPC ..... *A63C 13/005* (2013.01); *A63C 10/02* (2013.01); *A63C 10/24* (2013.01); *A63C 13/001* (2013.01); *A63C 13/006* (2013.01); *A63C 2203/06* (2013.01)

(58) Field of Classification Search

CPC ..... A63C 13/00; A63C 13/001; A63C 13/005; A63C 13/006; A63C 10/02; A63C 10/24; A63C 2203/06; A63C 5/02

See application file for complete search history.

(56) References Cited

U.S. PATENT DOCUMENTS

| | | | | |
|---|---|---|---|---|
| 7,681,904 | B2 * | 3/2010 | Ekberg | A63C 5/02 280/601 |
| 8,333,403 | B2 * | 12/2012 | Popel | A63C 7/005 280/604 |
| 9,827,481 | B2 * | 11/2017 | Ritter | A63C 9/10 |
| 2002/0083624 | A1 * | 7/2002 | Lansel | A43B 5/04 36/122 |
| 2013/0229000 | A1 * | 9/2013 | Ekberg | A63C 9/00 280/614 |

* cited by examiner

*Primary Examiner* — Brian L Swenson
(74) *Attorney, Agent, or Firm* — Regan L. Trumper; William W. Cochran; Cochran Freund & Young LLC

(57) ABSTRACT

A convertible binding comprising a base plate, a heel plate and a toe plate. The toe plate is rotatable from one end of a frame to either lie underneath the base plate or extend outward from the base plate to form a front portion of a snowshoe configuration. The heel plate is rotatable from a second end of the frame to either extend upward from the base plate to provide a heel back support for a snow board binding configuration to or extend outward from the base plate, in an opposing direction from said toe plate, to form a back portion of a snowshoe configuration. A mounting bracket with a forward and rear lip is attached to a snowboard and holds the convertible binding. A locking mechanism will hold the base plate down.

14 Claims, 9 Drawing Sheets

CONVERTIBLE BINDING

BACKGROUND OF THE INVENTION

Backcountry winter sports are popular. The term backcountry generally means anywhere that is not serviced by ski area lifts or where a participant, such as a snowboarder or skier, is required to hike in order to access terrain suitable for snowboarding or skiing. A backcountry snowboarder or skier may need to enter the backcountry or exit the backcountry without the aid of motorized assistance. Such motorized assistance may include ski lifts or vehicles such as snowmobiles or all-terrain vehicles. Such backcountry activity is often described as touring.

SUMMARY OF THE INVENTION

An embodiment of the invention may therefore comprise a convertible binding, said convertible binding comprising a frame comprising a first side and a second side wherein said frame has a toe end and a heel end, a toe plate rotatably connected at said toe end of said frame, wherein said toe plate is rotatable from a first position which is underneath said base plate to a second toe position which is extended from said base plate beyond said toe end of said frame, a base plate rotatably connected at said toe end of said frame, a heel plate rotatably connected to said first side and said second side of said frame at said heel end of said frame, wherein said heel plate is rotatable from a first position in which the heel plate is mostly perpendicular in respect to said base plate to a second heel position which is extended from said base plate beyond said heel end of said frame and opposite said toe plate extension.

An embodiment of the invention may further comprise a convertible apparatus for switching between a snowboard binding configuration and a snowshoe configuration, said apparatus comprising a convertible binding, said convertible binding comprising a frame comprising a first side and a second side wherein said frame has a toe end and a heel end, a toe plate rotatably connected at said toe end of said frame, wherein said toe plate is rotatable from a first position which is underneath said base plate to a second toe position which is extended from said base plate beyond said toe end of said frame, a base plate rotatably connected at said toe end of said frame, a heel plate rotatably connected to said first side and said second side of said frame at said heel end of said frame, wherein said heel plate is rotatable from a first position in which the heel plate is mostly perpendicular in respect to said base plate to a second heel position which is extended from said base plate beyond said heel end of said frame and opposite said toe plate extension, and a mounting bracket enabled to attach to a snowboard, said mounting bracket comprising a front bracket lip, a rear bracket lip and at least one sash lever, wherein said mounting bracket is enabled to hold said convertible binding in place on said snowboard by engaging a toe plate lip fitting in said rear bracket lip, engaging a base plate lip fitting in said front mounting bracket lip and by holding said base plate firmly down with said sash lever.

An embodiment of the invention may further comprise a method of converting a binding, said method comprising connecting a toe plate to a toe end of a frame, connecting a base plate to a toe end of a frame, said base plate having a heel flat position and a heel lifted position, connecting a heel plate to a heel end of a frame, rotating said toe plate from a first toe position to a second toe position, wherein said second toe position extends beyond the toe end of said frame and is in substantial line with said base plate when said base plate is in said heel flat position, rotating said heel plate from a first heel position to a second heel position, wherein said second heel position extends beyond the heel end of said frame and is in substantial line with said base plate when said base plate is in said heel flat position.

An embodiment of the invention may further comprise a method of attaching a convertible binding to a mounting bracket, wherein said mounting bracket comprises a front mounting bracket lip, a rear mounting bracket lip and at least one sash lever, said convertible binding comprises a rotatable toe plate, a rotatable base plate and a rotatable heel plate, said method comprising attaching said mounting bracket to a snowboard, rotating said toe plate to an underside of said base plate, rotating said heel plate to an upright position, placing a toe plate lip fitting and a rear frame strut in said rear mounting bracket lip, rotating said base plate upward to allow a base plate lip fitting to engage said front mounting bracket lip, rotating said base plate downward to substantially parallel with said snow board, engaging said at least one sash lever to hold said base plate.

DETAILED DESCRIPTION OF THE EMBODIMENTS

Embodiments of the invention are directed toward a new and useful system and method for a convertible binding.

Figure 1:
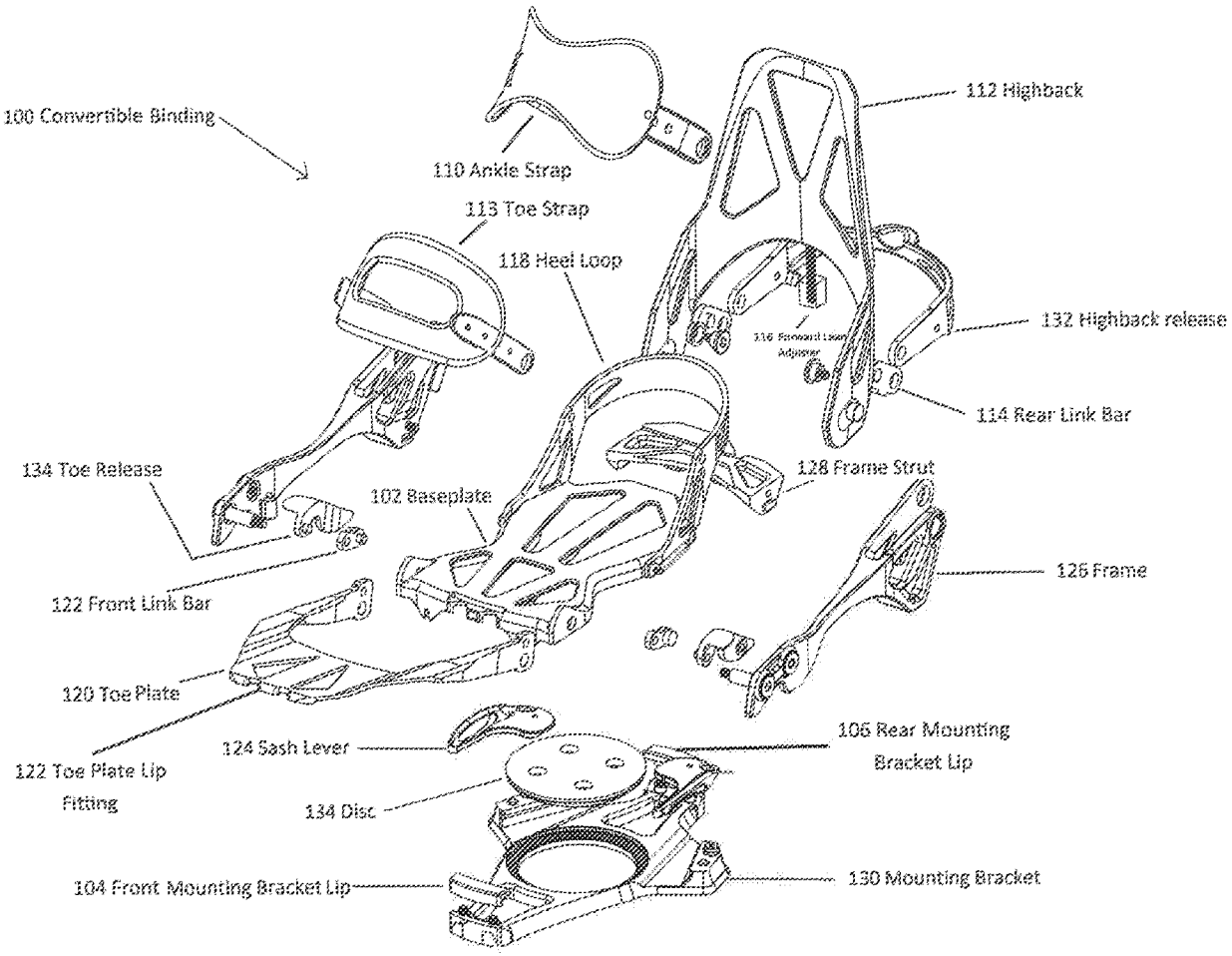
FIG. 1 shows an exploded view of an embodiment of a convertible binding.

FIG. 1 shows an exploded view of an embodiment of a convertible binding. A convertible binding 100 comprises a high back support 112 that is at a rear position to a base plate 102 that connects to a frame 126 at a location of the base plate 102 substantially the same as a toe plate 120. The high back support 112 has a forward lean adjuster 116 that provides an adjustment for how far forward the high back support 112 is in the up position. The high back support 112 may also be referred to as a heel plate. The up position is when the convertible binding 100 is in a position for a snowboard binding. In the upward snowboard binding position, the forward lean adjuster 116 is enabled to make contact with a high heel loop 118. The high back support 112 is rotatable to a lowered position by movement of the forward lean adjuster 116 to a position to avoid contact with the heel loop 118. Those skilled in the art will understand different methods of providing a forward lean adjustment that allows a snowboarder to adjust the high back support 112. The forward lean adjuster 116 may be moveable from the contact position with the heel loop 118 by a simple swing arm (or other mechanism) connected to the high back support 112. Those skilled in the art will understand different methods and systems of providing moveable contact of the forward lean adjuster 116 with the high back support 112.

Figure 6:
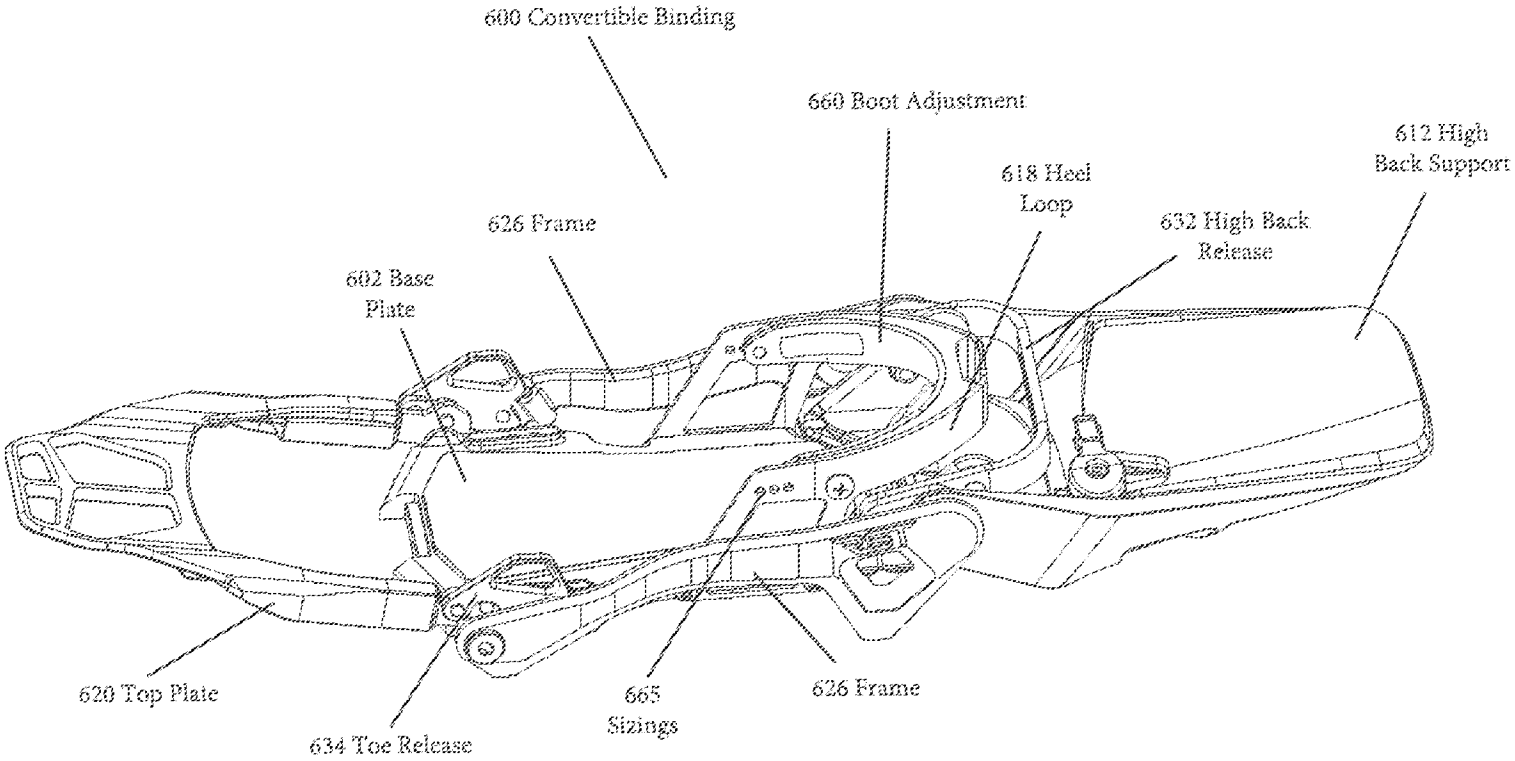
FIG. 6 shows a perspective view of an embodiment of a convertible binding in a show shoe configuration and base plate not rotated.

The high back release 132 is in contact with the high back support 112 via a link bar 114. The link bar 114 connection allows the high back support 112 and the high back release 132 to rotate in relation to each other. The high back support 112 is rotatable from an upward position, as shown in FIG. 1, to a downward snowshoe position as shown in FIG. 6.

The baseplate 102 is rotatable in relation to the high back support 112 at the connection point. The base plate 102 provides a platform for a user to connect to. A heel loop 118 is connected to the base plate 102. The heel loop 118 provides a back heel support for a snow board boot, or other boot or fitting, in the convertible binding 100. The heel loop 118 may have an adjustment mechanism to provide adjustment for different sized boots or fittings. A user's snowboard boot sits on top of the base plate 102 and is held in position by the heel loop 118. An ankle strap 110 and a toe strap 113 connect to the base plate 102. The ankle strap 110 and the toe strap 113 are enabled to hold a boot, or other fitting, in place against the base plate 102.

A toe plate 120 connects to the front link bar 122. The toe plate 120 may be connected to the base plate opposite the high back support 112. The front link bar 122 connects to the toe release 134. The toe release connects to the frame 126. The front link bar 122 is part of a four bar over the center locking mechanism. A four-bar linkage, also called a four-bar, is movable closed chain linkage. It consists of four bodies, called bars or links, connected in a loop by four joints. Generally, the joints are configured so the links move in parallel planes, and the assembly is called a planar four-bar linkage. The link bar 122 may be connected to the toe plate 120 which is connected to the base plate 102. The base plate 102 is connected with a shoulder bolt or other connector. The toe release 134 may be connected to the link bar 122 with pins, or other connectors. The toe plate 120 is rotatable in relation to the base plate 102. The toe plate 120 may be in an extended snowshoe position (as shown in FIG. 1). The toe plate 120 is rotatable to a snowboard position in which it will be under the baseplate 102. In the snowboard configuration position, a boot or other fitting will sit on top of the base plate 102.

A frame 126 may be on either side of the base plate 102. The frame 126 pieces will be on opposite sides of the base plate 102 and may be connected to each other by a frame strut 128. The frame 126 and frame strut 128 may provide connection points for the base plate 102, toe plate 120, the high back support 112 and the high back release 132. The frame 126 may not be connected to the base plate 102 to allow forward and upward rotation of the base plate 102 in the snowshoe configuration. The toe plate 120 may be connected to the base plate 102 at a common connection to the frame 126 on both sides of the base plate 102. The high back support 112 may be connected to the base plate 102 at a common connection to the frame 126 on both sides of the base plate 102.

A link bar 122 may be connected to the connection point between the toe plate 120 and the base plate 102. The toe release 134 may be connected to the frame 126 or to the link bar 122. The toe release may also be connected to the frame 126. The toe release 134 is part of a locking mechanism that enables the toe plate 120 to be locked in the snowshoe position. A front link bar 122 may be connected between the toe release 134 and the connection to the toe plate 120. Those skilled generally in the art of mechanical devices will understand other locking mechanisms that releasably lock one piece in line with another piece.

The convertible binding 100 may connect to a mounting bracket 130 which may be connected to a snowboard (not shown). The mounting bracket 130 may have a rotatable disk 134 that allows the convertible binding 100 to be connected at a desired angle in relation to a snowboard. The mounting bracket may have a mounting bracket lip and a sash lever 124 to provide for release of the convertible binding 100.

The convertible binding 100 is held in place on a snowboard (not shown) by the mounting bracket 130. The mounting bracket 130 is attached to a snowboard. The convertible binding 100 is attachable to the mounting bracket 130. The convertible binding 100 may be released from the mounting bracket 130 and converted into a snowshoe configuration. The mounting bracket 130 may be attached to a snowboard. When the toe plate 120 is folded under the base plate 102, the toe plate lip fitting 122 faces toward the rear of the convertible binding 100. The mounting bracket 130 has a front mounting bracket lip 104 and a rear mounting bracket lip 106. The toe plate lip fitting 122 and the rear strut 128 can be situated under the rear mounting bracket lip 106. The base plate 102 can be tilted forward to allow the front of the base plate to drop under the front mounting bracket lip 104. The base plate 102 can be dropped back down at this point and the base plate 102 will firmly engage the front mounting bracket lip 104 and the rear mounting bracket lip 106. The sash levers 124 can then be pushed inward to engage the base plate 102. With the sash levers 124 push inward, the base plate is unable to tilt forward. In such an engagement, the convertible binding 100 is firmly held by the mounting bracket 130.

Figure 2:
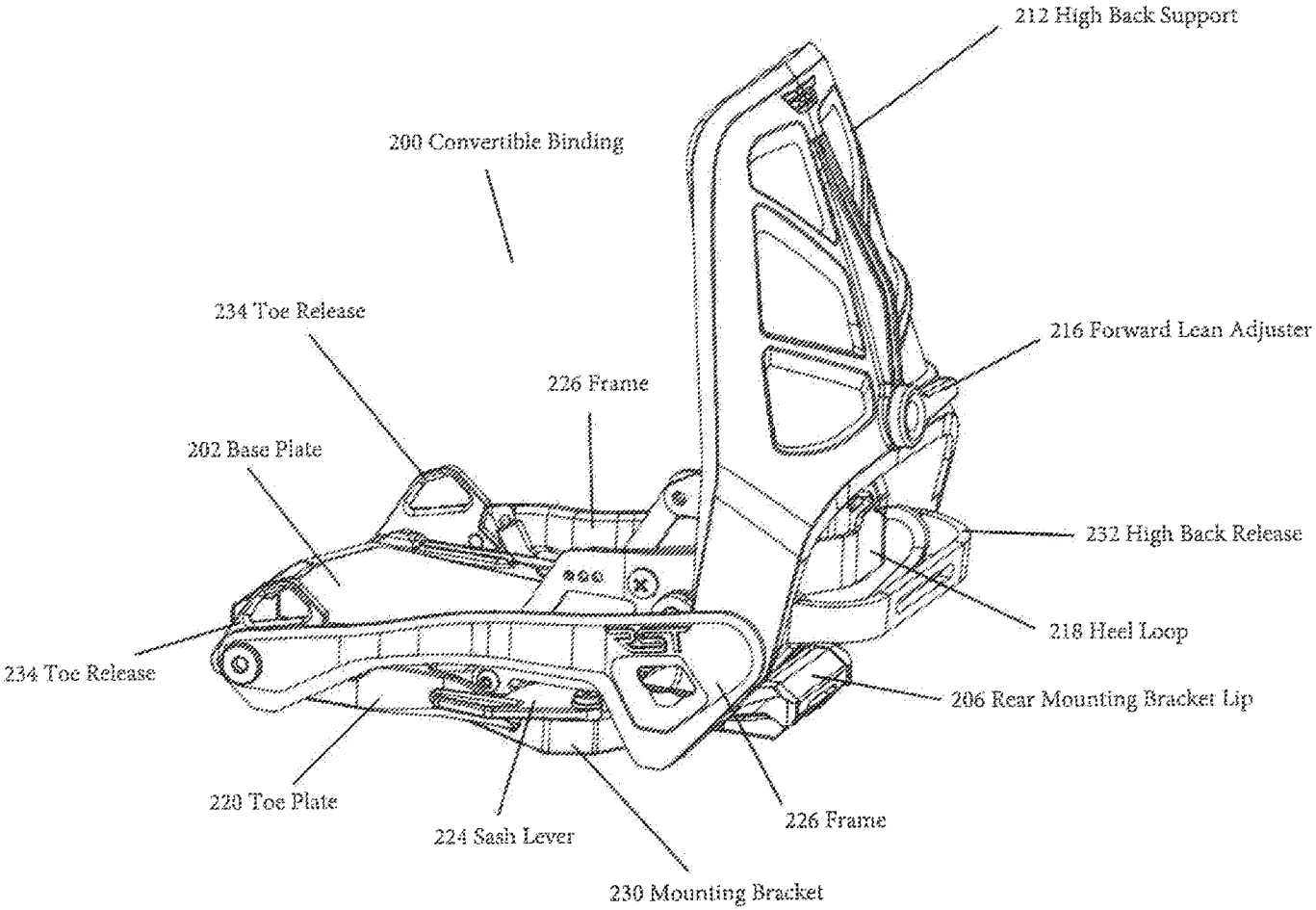
FIG. 2 shows a perspective view of an embodiment of a convertible binding.

FIG. 2 shows a perspective view of an embodiment of a convertible binding. The convertible binding 200 may comprise a base plate 202, a high back support 212 and a toe plate 220. The toe plate 220 is rotated into a snow board configuration and sits under the base plate 202. A forward lean adjuster 216 is shown without a connector to the heel loop 118. The frame 226 is on both lateral sides of the base plate 202. The sash lever 224 holds the base plate 202 down to a mounting bracket 230 when the convertible binding is in a snowboard binding configuration as shown. The sash lever 224 may be used to release the base plate 202 to allow the base plate 202 to rotate upward and forward at a connection at the front of the base plate 202. A toe release 234 is connected to the frame 226 and also connected to the link bar (not shown in FIG. 2. The toe plate 220 may rotate into a snowshoe configuration around the connection point. A heel loop 218 is shown connected to the base plate 202.

Figure 3:
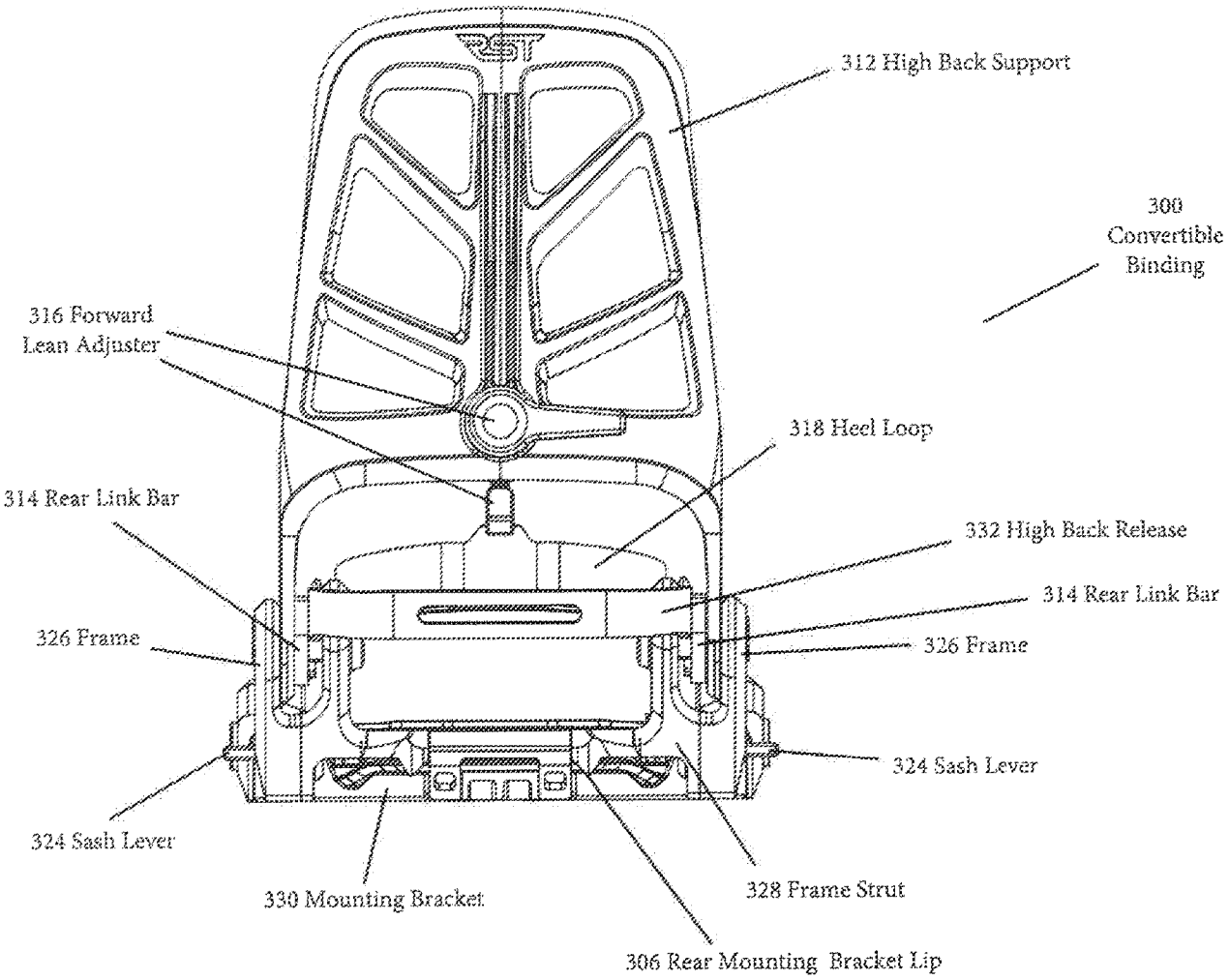
FIG. 3 shows a rear view of a convertible binding.

FIG. 3 shows a rear view of a convertible binding. The convertible binding 300 has a high back support 312. The high back support 312 is connected to a frame 326 on both the left and right side. The frame 326 is supported by a frame strut 328 between the left and right side. A sash lever 324 allows the convertible binding 300 to be releasable from a mounting bracket 330. A forward lean adjuster 316 is shown in contact with the heel loop 318. The forward lean adjuster 316 is positionable in contact with the heel loop 318 to disallow backward rotation of the high back support 312.

The frame 326 is connected to the high back release 332. The high back release 332 is connected to the rear link 314. The real link bar 314 is also connected to the high back support 312. The high back support 112 is also connected to the frame 326. The rear link bar 314 is part of a four bar over the center locking mechanism. A four-bar linkage, also called a four-bar, is movable closed chain linkage. It consists of four bodies, called bars or links, connected in a loop by four joints. Generally, the joints are configured so the links move in parallel planes, and the assembly is called a planar four-bar linkage. The rear link bar 314 may bar connected with a shoulder bolt or other connector.

In an embodiment of the invention, the frame strut 328 connects to the frame 326 on both the left and right side. The frame strut 328 also connects to the high back release 332. The high back release 332 also connects to the rear link bar 314. The rear link bar 314 also connects to the high back support 312. The high back support connects to the frame 326. A four-bar over the center locking mechanism is utilized to lock the high back support 312 in a lowered, snowshoe configuration.

Figure 4:
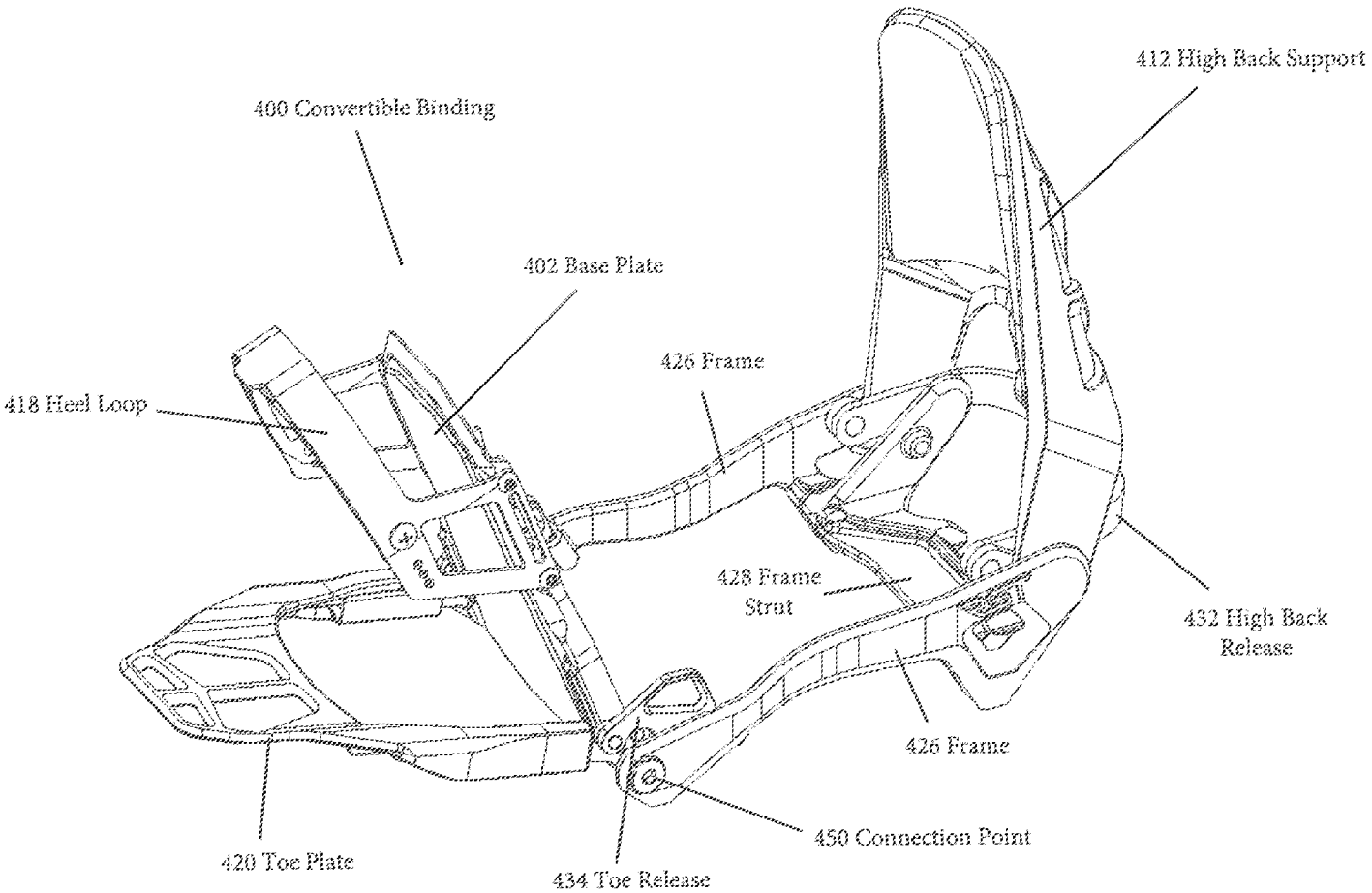
FIG. 4 shows a perspective view of an embodiment of a convertible binding partially between configurations.

FIG. 4 shows a perspective view of an embodiment of a convertible binding partially between configurations. The convertible binding 400 has a high back support 412. The high back support 412 is shown in the upright, snow board configuration. The high back support 412 connects to a frame 426 on the left and right side. A screw, or other method of connection, may be used to connect the left and right frame pieces 426 to the frame strut 428. The left and right part of the frame 426 are connected by a frame strut 428. A high back release 432 is connected to the frame strut 428 at two locations. The heel loop 418 provides a point of contact for a forward lean adjuster (not shown). The forward lean adjuster (not shown) can be taken out of contact with the heel loop 418 to allow the high back support 412 to pivot downward and to the rear into a snowshoe configuration. A heel loop 418 is connected to the base plate 402. The base plate 402 is rotated upward and forward. The base plate 402 is enabled to rotate upward and forward to improve the performance of the convertible binding 400 when it is in the snowshoe configuration. The rotation of the base plate 402 enables a more natural walking gate and enables the convertible binding 400 to maintain more constant contact with the ground. A toe plate 420 is attached to the frame 426 and is rotated in a snowshoe configuration. The toe plate 420 will lock into the snowshoe configuration by means of the toe release 434 and link bar locking mechanism. The toe release 434 is part of a locking mechanism that allows easy unlocking to rotate the toe plate back 420 into the snow board configuration.

Figure 5:
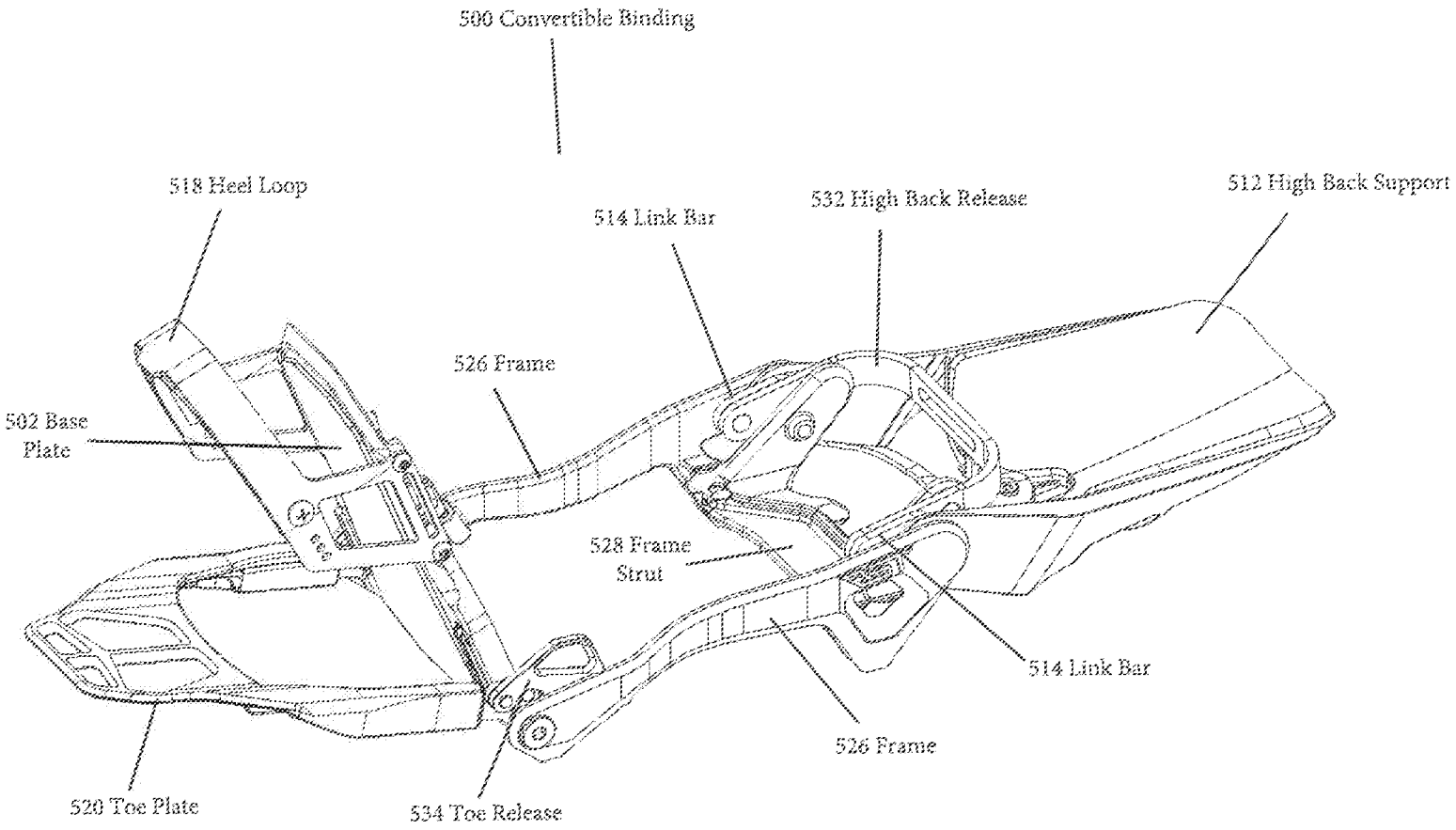
FIG. 5 shows a perspective view of an embodiment of a convertible binding in a snowshoe configuration and base plate rotated.

FIG. 5 shows a perspective view of an embodiment of a convertible binding in a snowshoe configuration and base plate rotated. A high back support 512 is connected to a frame 526 on both the left and the right side. The high back support 512 is rotated from an upright position (FIG. 2 for instance) into a lowered, snowshoe configuration. The frame 526 is connected by a frame strut 528. A high back release 532 is connected to the frame strut 528 on the left and right side. The high back release 532 is connected to the high back support 512 by means of a link bar 514. The high back support 512 locks in the snowshoe configuration. The high back release 532 provides a locking mechanism to unlock the high back support 512 and allow it to be rotated upward into the snow board configuration. Those skilled generally in the art of mechanical devices will understand different methods and systems for providing a locking mechanism for the high back support 512. A base plate 502 is connected to the frame 526 on both the left and right side. The base plate 502 is shown in an upward and forward rotated position. A heel loop 518 is connected to the base plate 502. A toe plate 520 is connected to the frame 526 on both the left and right side. The toe plate 520 is rotated into a snowshoe configuration. The toe release 534 keeps the toe plate 520 locked in the snowshoe configuration. In an embodiment of the invention, the toe release 534 is enabled to be pulled upward (on both sides) to release the toe plate 520. Those skilled generally in the art of mechanical devices will understand different methods and systems for providing a locking mechanism on a rotating member relative to a stationary frame.

FIG. 6 shows a perspective view of an embodiment of a convertible binding in a show shoe configuration and base plate not rotated. A high back support 612 is connected to a frame 626 on both the left and the right side. The high back support 612 is rotated from an upright position (FIG. 2 for instance) into a lowered, snowshoe configuration. The frame 626 is connected by a frame strut 628. A high back release 632 is connected to the frame strut (not shown) on the left and right side. The high back release 632 is connected to the high back support 612 by means of a link bar 614. The high back support 612 locks in the snowshoe configuration. The high back release 632 provides a locking mechanism to unlock the high back support 612 and allow it to be rotated upward into the snow board configuration. Those skilled in the art will understand different methods and systems for providing a locking mechanism for the high back support 612. A base plate 602 is connected to the frame 626 on both the left and right side by means of a four bar locking mechanism. The base plate 602 is shown in an un-rotated, down position. A heel loop 618 is connected to the base plate 602. A toe plate 620 is connected to the frame 626 on both the left and right side by means of a four bar locking mechanism. The toe plate 620 is rotated into a snowshoe configuration. The toe release 634 keeps the toe plate 620 locked in the snowshoe configuration. In an embodiment of the invention, the toe release 634 is enabled to be pulled upward (on both sides) to release the toe plate 620. Those skilled in the art will understand different methods and systems for providing a locking mechanism for the toe plate 620.

Continuing with FIG. 6, a boot adjustment 660 is shown connected to the heel loop 618. The boot adjustment 660 may be connected to different positions of the sizings 665. Accordingly, different sized boots, or fittings, can be accommodated. Those skilled in the art will understand different methods and systems for providing an adjustability to the boot adjustment 660.

Figure 7:
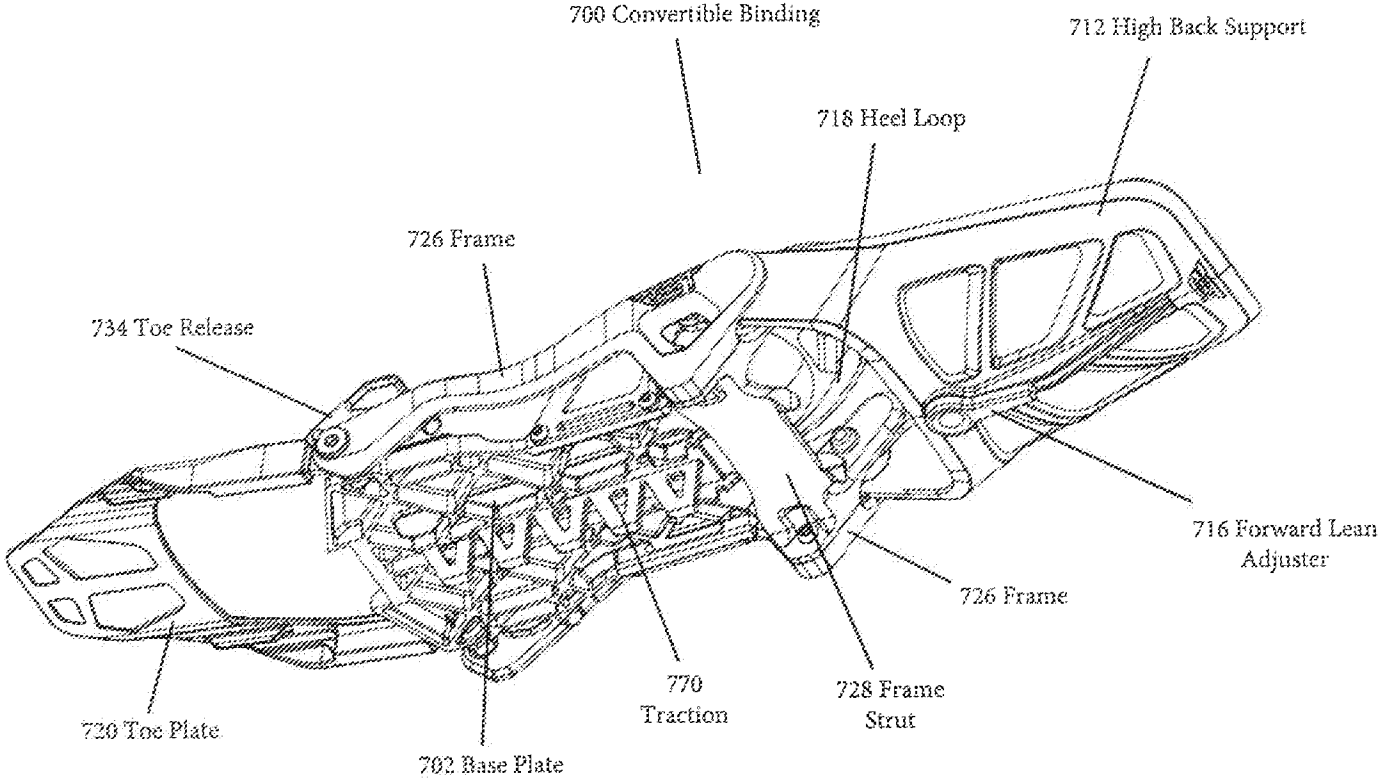
FIG. 7 shows an underneath perspective view of an embodiment of a convertible binding in a show shoe configuration.

FIG. 7 shows an underneath perspective view of an embodiment of a convertible binding in a show shoe configuration. A high back support 712 is connected to a frame 726 on both the left and the right side. The high back support 712 is rotated from an upright position (FIG. 2 for instance) into a lowered, snowshoe configuration. The frame 726 is connected by a frame strut 728. The high back release (not visible in FIG. 7) is connected to the frame strut 728. The high back support 712 locks in the snowshoe configuration. A base plate 702 is connected to the frame 726 on both the left and right side by means of a four bar locking mechanism. The base plate 702 is shown in an un-rotated, down position. A heel loop 718 is connected to the base plate 702. A toe plate 720 is connected to the frame 726 on both the left and right side by means of a four bar locking mechanism. The toe plate 720 is rotated into a snowshoe configuration. The toe release 734 keeps the toe plate 720 locked in the snowshoe configuration. In an embodiment of the invention, the toe release 734 is enabled to be pushed upward (on both sides) to release the toe plate 720. Those skilled in the art will understand different methods and systems for providing a locking mechanism for the toe plate 720. The base plate 702 may have traction 770 on the underside to aid in moving through snowy areas. Such traction may be a crampon type device that is easily removeable and easily put in place. Through out this description, the toe release 734 is described as being pulled upward to unlock the toe plate for rotation back to a snowboard binding configuration. Embodiments of the invention may include varying locking mechanisms that require movement of a toe release in any direction to unlock the toe plate.

Figure 8:
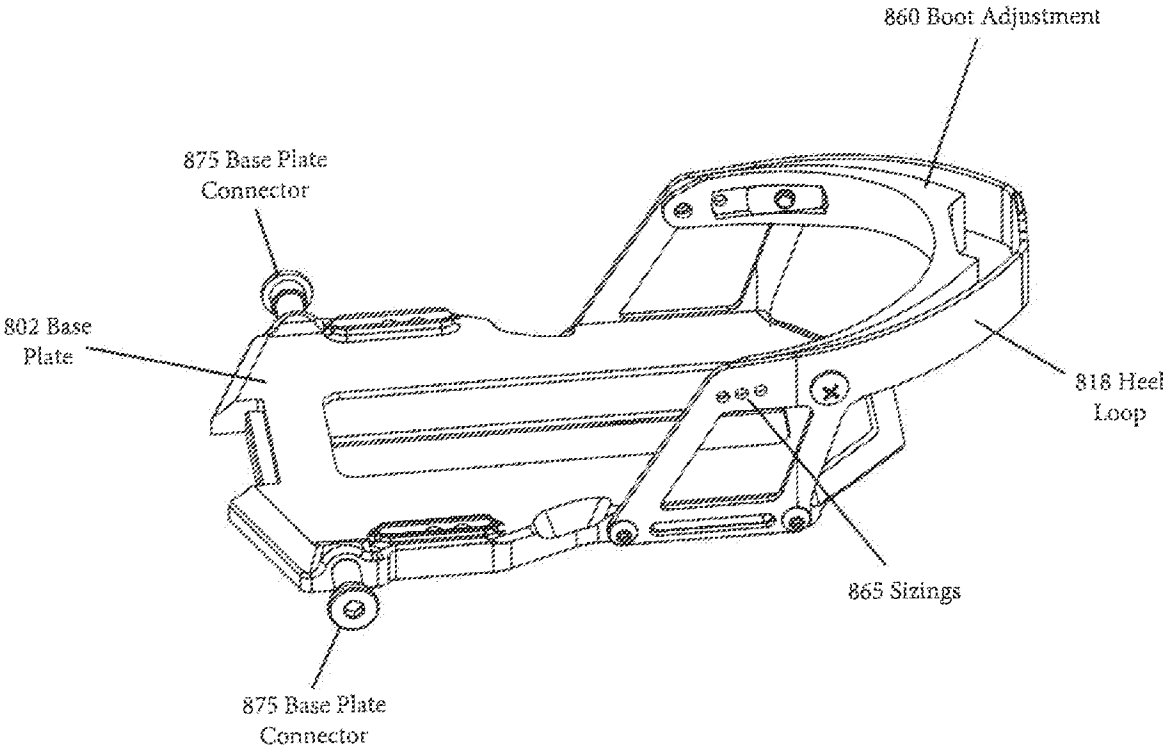
FIG. 8 shows a base plate with an adjustable boot sizer in a small configuration.

FIG. 8 shows a base plate with an adjustable boot sizer in a small configuration. The base plate 802 is connected to a heel loop 818. The heel loop 818 may be a single piece or it may be multiple pieces that fit together to form a heel loop 818. The heel loop has a set of three sizings 865. The sizings 865 accept connection from a boot adjustment 860 that allows a user to adjust the sizing to fit different sized boots. It is understood that there may be more, or fewer, than three sizing adjustments 865 on each side of the heel loop 818. As shown in FIG. 8, the boot adjustment 860 is fixed on the smallest boot sizing 865. The boot adjustment 860 can be adjusted to any of the larger sizings 865 at the discretion of a user. It is understood that those skilled in the art will understand different methods and systems for allowing boot sizing adjustments. For instance, a center portion of the boot adjustment 860 may contain a series of boot sizings that allow the boot adjustment to be tightened or loosened at the discretion of the user.

Figure 9:
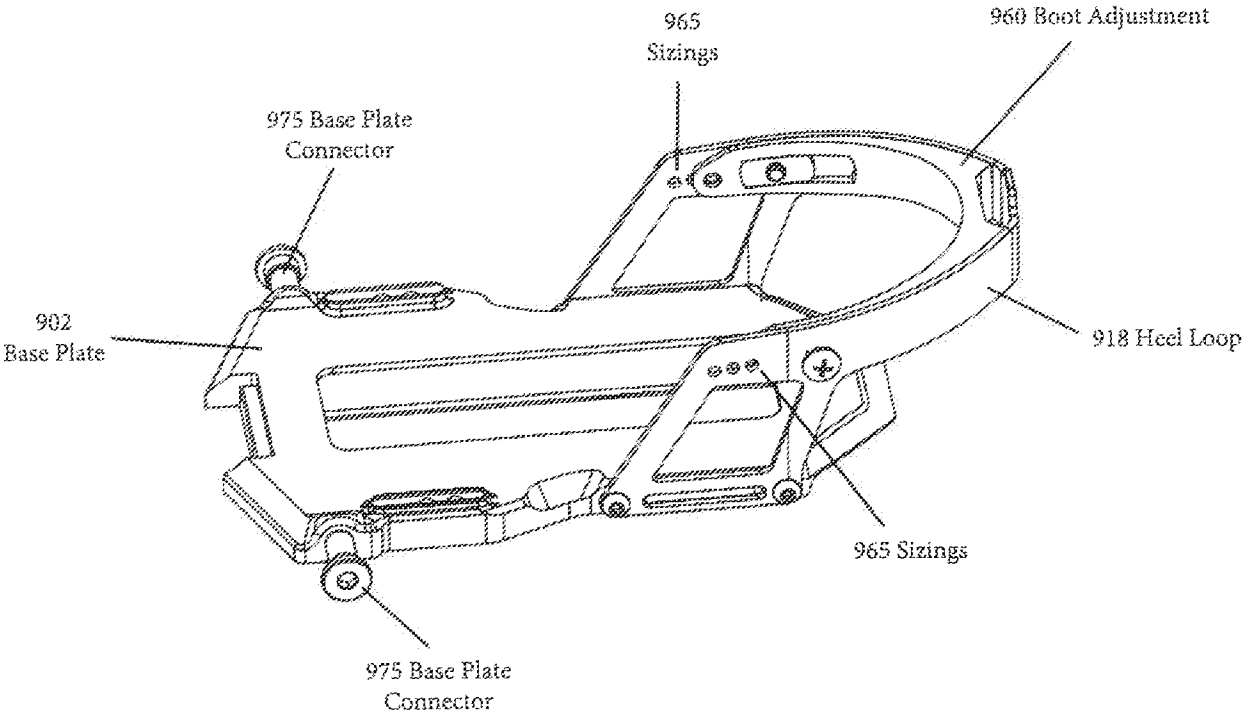
FIG. 9 shows a base plate with an adjustable boot sizer in a large configuration.

FIG. 9 shows a base plate with an adjustable boot sizer in a large configuration. The base plate 902 is connected to a heel loop 918. The heel loop 918 may be a single piece or it may be multiple pieces that fit together to form a heel loop 918. The heel loop has a set of three sizings 965. The sizings 965 accept connection from a boot adjustment 960 that allows a user to adjust the sizing to fit different sized boots. It is understood that there may be more, or fewer, than three sizing adjustments 965 on each side of the heel loop 918. As shown in FIG. 9, the boot adjustment 860 is fixed on the largest boot sizing 965. The boot adjustment 960 can be adjusted to any of the larger sizings 965 at the discretion of a user. It is understood that those skilled in the art will understand different methods and systems for allowing boot sizing adjustments. For instance, a center portion of the boot adjustment 960 may contain a series of boot sizings that allow the boot adjustment to be tightened or loosened at the discretion of the user.

Embodiments of the convertible binding enable a snowboarder to access terrain that is accessible with snowshoes, split boards or cross country skis. It is understood that the convertible binding is not limited to any particular end-use.

Embodiments of the convertible binding enable a user to eliminate the extra gear and weight on hikes by eliminating extra weight caused by carrying snowboard bindings. The weight of carrying extra weight on a snowboard ride down a mountain is also reduced.

Embodiments of the convertible binding enable a user to eliminate the extra gear and weight on hikes by eliminating extra weight caused by carrying snowshoes. The weight of carrying extra weight on a snowboard ride down a mountain is also reduced.

Embodiments of the convertible binding also reduce the conversion time between riding a snowboard and snowshoeing.

As shown in FIG. 1-9, the convertible binding is convertible from a snowboard binding configuration to a snowshoe configuration. A high back support and a toe plate are foldable from a snowboard binding configuration to a snowshoe configuration. In the snowboard binding configuration, the toe plate may lie underneath a base plate and the high back support may rise substantially perpendicular from the base plate. The high back support is adjustable to allow for different preferred leans so that the perpendicular aspect of the high back support may vary.

In an embodiment of the convertible binding, the convertible binding is converted from a snowboard binding configuration to a snowshoe configuration. The forward lean adjuster may be rotated to allow the high back support to fold from a substantially vertical with the base plate position to a substantially in-line (parallel) with the base plate position. The high back support will lock in the parallel position. The convertible binding may be disengaged from the mounting bracket that is affixed to a snowboard. The convertible binding may be disengaged from the mounting bracket by use of the sash levers on each side of the mounting bracket. The base plate heel portion may be lifted upward so that the front of the base plate clears the mounting bracket lip attached to the front of the mounting bracket. The toe plate may be pivoted independently from lying under the base plate into a snowshoe configuration.

Throughout this specification, reference has been made to the toe plate and high back support rotating. This term is herein used to indicate that the toe plate and high back support rotate around their connection points. Other terms are intended to indicate the same motion. Those terms may include pivot, slide or flip, among other terms.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A convertible binding, said convertible binding comprising:

a frame comprising a first side and a second side wherein said frame has a toe end and a heel end;

a base plate rotatably connected at said toe end of said frame;

a toe plate rotatably connected at said toe end of said frame, wherein said toe plate is rotatable from a first position which is underneath said base plate to a second toe position which is extended from said base plate beyond said toe end of said frame;

a heel plate rotatably connected to said first side and said second side of said frame at said heel end of said frame, wherein said heel plate is rotatable from a first position in which the heel plate is mostly perpendicular in respect to said base plate to a second heel position which is extended from said base plate beyond said heel end of said frame and opposite said toe plate extension.

2. The convertible binding of claim 1, said convertible binding further comprising:

a frame strut that connects said first side of said frame to said second side of said frame;

a first toe release connected to said first side of said frame at said toe end of said frame;

a second toe release connected to said second side of said frame at said toe end of said frame;

a first toe lock connected to said first toe release;

a second toe lock connected to said second toe release.

3. The convertible binding of claim 2, wherein said first toe lock comprises a front link bar and said second toe lock comprises a second link bar.

4. The convertible binding of claim 2, wherein said first toe lock comprises a four bar over the center locking mechanism and said second toe lock comprises a four bar over the center locking mechanism.

5. The convertible binding of claim 1, said convertible binding further comprising a heel loop connected to said base plate, said heel loop enabled to secure a heel of a fitting inserted into said convertible binding.

6. The convertible binding of claim 5, wherein said heel loop comprises a boot sizing adjustment.

7. The convertible binding of claim 1, said convertible binding further comprising a high back support connected to said first side and said second side of said frame at said heel end of said frame and a forward lean adjuster connected to said heel plate, wherein said forward lean adjuster is enabled to adjust the lean angle of said heel plate when said forward lean adjuster is in contact with said heel loop.

8. The convertible binding of claim 1, said convertible binding further comprising a heel plate release, wherein said heel plate release is connected in a four bar over the center locking arrangement wherein a frame strut connecting said first side of said frame to said second side of said frame is connected to said heel plate release, said heel plate release is connected to a rear link bar, said rear link bar is connected to said heel plate, and said heel plate is connected to said first side and said second side of said frame.

9. A convertible apparatus for switching between a snowboard binding configuration and a snowshoe configuration, said apparatus comprising:

a convertible binding, said convertible binding comprising:

a frame comprising a first side and a second side wherein said frame has a toe end and a heel end;

a toe plate rotatably connected at said toe end of said frame, wherein said toe plate is rotatable from a first position which is underneath said base plate to a second toe position which is extended from said base plate beyond said toe end of said frame;

a base plate rotatably connected at said toe end of said frame;

a heel plate rotatably connected to said first side and said second side of said frame at said heel end of said frame, wherein said heel plate is rotatable from a first position in which the heel plate is mostly perpendicular in respect to said base plate to a second heel position which is extended from said base plate beyond said heel end of said frame and opposite said toe plate extension; and a mounting bracket enabled to attach to a snowboard, said mounting bracket comprising a front bracket lip, a rear bracket lip and at least one sash lever, wherein said mounting bracket is enabled to hold said convertible binding in place on said snowboard by engaging a toe plate lip fitting in said rear bracket lip, engaging a base plate lip fitting in said front mounting bracket lip and by holding said base plate firmly down with said sash lever.

10. A method of converting a binding, said method comprising:

connecting a toe plate to a toe end of a frame;

connecting a base plate to a toe end of a frame, said base plate having a heel flat position and a heel lifted position;

connecting a heel plate to a heel end of a frame;

rotating said toe plate from a first toe position to a second toe position, wherein said second toe position extends beyond the toe end of said frame and is in substantial line with said base plate when said base plate is in said heel flat position;

rotating said heel plate from a first heel position to a second heel position, wherein said second heel position extends beyond the heel end of said frame and is in substantial line with said base plate when said base plate is in said heel flat position.

11. The method of claim 10, wherein said method of rotating said toe plate comprises rotating said toe plate to a second locked toe plate position and said method of rotating said heel plate comprises rotating said heel plate to a locked heel plate position.

12. The method of claim 11, said method further comprising:

locking said toe plate in said second toe position with a four bar over the center locking mechanism;

locking said heel plate in said second toe position with a four bar over the center locking mechanism.

13. The method of claim 10, wherein said frame comprises a first and a second side and said method further comprises connecting said first side and said second side to a frame strut.

14. A method of attaching a convertible binding to a mounting bracket, wherein said mounting bracket comprises a front mounting bracket lip, a rear mounting bracket lip and at least one sash lever, said convertible binding comprises a rotatable toe plate, a rotatable base plate and a rotatable heel plate, said method comprising:

attaching said mounting bracket to a snowboard;

rotating said toe plate to an underside of said base plate;

rotating said heel plate to an upright position;

placing a toe plate lip fitting and a rear frame strut in said rear mounting bracket lip;

rotating said base plate upward to allow a base plate lip fitting to engage said front mounting bracket lip;

rotating said base plate downward to substantially parallel with said snow board;

engaging said at least one sash lever to hold said base plate.

* * * * *